United States Patent [19]

Pofferi

[11] Patent Number: 4,905,615

[45] Date of Patent: Mar. 6, 1990

[54] APPARATUS FOR AUTOMATING THE FORMATION OF A COVERING ON THE CARCASS OF A MATTRESS

[75] Inventor: Vittorio Pofferi, Rome, Italy

[73] Assignee: Permaflex S.p.A., Rome, Italy

[21] Appl. No.: 282,377

[22] Filed: Dec. 9, 1988

[30] Foreign Application Priority Data

Dec. 11, 1987 [IT] Italy ..... 9573 A/87

[51] Int. Cl.[4] ..... D05B 11/00

[52] U.S. Cl. ..... 112/2.1; 112/121.14; 112/129; 112/138

[58] Field of Search ..... 112/3 R, 3 A, 2.1, 2.2, 112/153, 127, 129, 121.14, 138

[56] References Cited

U.S. PATENT DOCUMENTS

| | | | |
|---|---|---|---|
| 1,857,371 | 5/1932 | Gail | 112/2.1 |
| 2,609,768 | 9/1952 | Cash et al. | 112/2.1 |
| 2,918,884 | 12/1959 | Kalning et al. | 112/2.1 |
| 2,925,057 | 2/1960 | Cash, Sr. | 112/2.1 |
| 3,062,160 | 11/1962 | Cash, Sr. et al. | 112/2.1 |
| 3,664,280 | 5/1972 | Redman et al. | 112/2.1 |
| 4,155,317 | 5/1979 | Enomoto | 112/2.1 |
| 4,799,438 | 1/1989 | Hinckle | 112/121.14 X |

*Primary Examiner*—H. Hampton Hunter

*Attorney, Agent, or Firm*—McGlew & Tuttle

[57] ABSTRACT

The tape-like facing band is fitted annularly around the carcass (M) and the front surface of the casing is supported on said carcass, which is received in a containing structure (3) with a boundary edge (3B) from which the carcass and the facing band partially project; a guide rail (7,9) extends around said edge for a supporting carriage (20) which has orientable rollers (24) for passing over the curves at the corners and is motorized; a further trolley (42) is movable on said rails and connected to said supporting carriage by an articulation (40); a cutter (18) is capable of acting in a position in front of that of the stitcher.

8 Claims, 8 Drawing Sheets

88
16
VII
16
X
f88
14
IX
T
106
86
108
X
M
88B
84
82
110
IX
92
F
90
20
80
3B
28
3
3A
26
30
24
1
9
VII
5
38
20

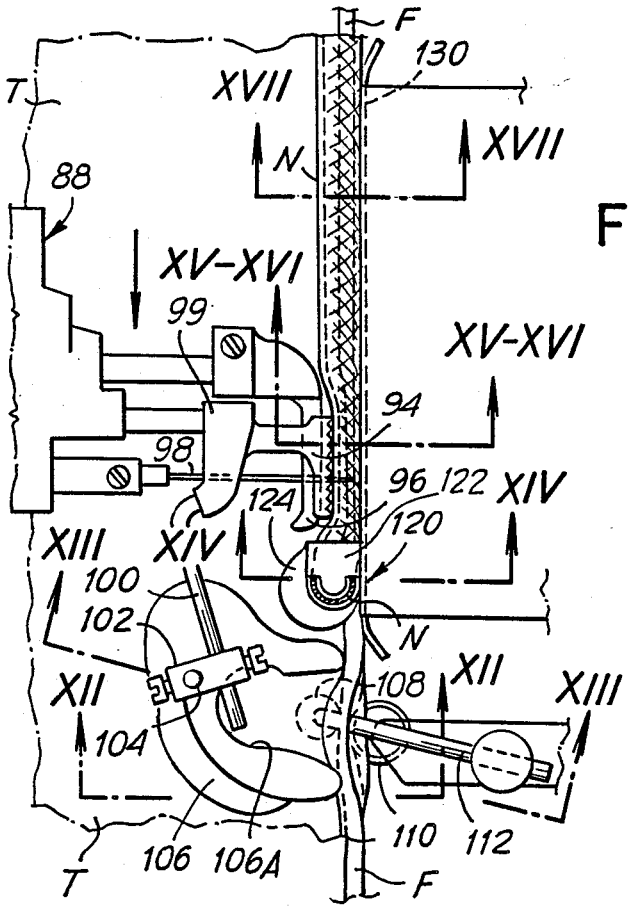
Fig.9
Fig.10
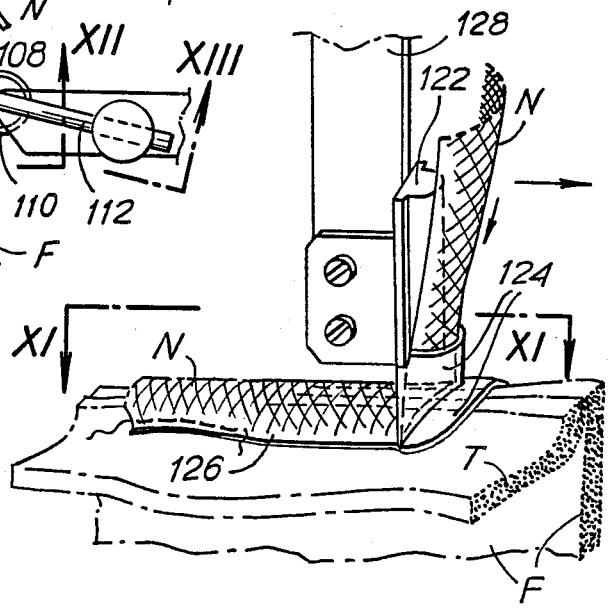
Fig.11
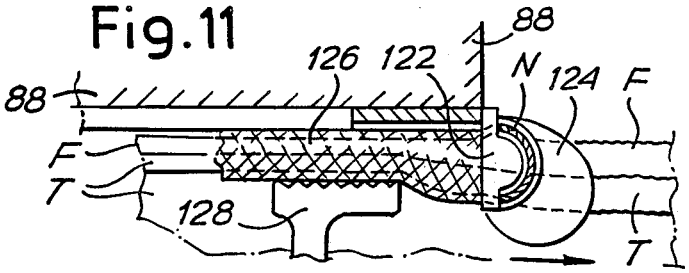

APPARATUS FOR AUTOMATING THE FORMATION OF A COVERING ON THE CARCASS OF A MATTRESS

SUMMARY OF THE INVENTION

The object of the invention is to obtain a substantially automated production of covered mattresses, with an appreciable uniformity of size and shape of the casing of the covering.

According to the invention, an apparatus for forming, on the carcass or body of a mattress, a casing or shell with edging tape along the boundary edges of the principal front surfaces, by means of a stitcher acting along an inclined direction, substantially comprises in combination: a structure for containing the carcass of the mattress with the tape-like facing band fitted annularly around the carcass and with the front surface of the casing supported on said carcass, said containing structure exhibiting a boundary edge from which the carcass and the facing band partially project; guide rail means extending around said edge; a supporting carriage supported and movable on said rail means by means of rollers which are orientable for passing over the curves at the corners; on said carriage supporting and actuating means with a toothed wheel, which engage with a rack extending in the manner of said rail means; a further trolley which is movable on said rail means and which is connected to said supporting carriage by an articulation; on said carriage or on said trolley, a stitcher, and on the other a cutter capable of acting in a position in front of that of the stitcher.

The apparatus also comprises means for drawing the fabric of the facing band and means for drawing the front surface of the casing or shell, for their positioning in the stitching position.

In a practical embodiment, on said supporting carriage slide means are provided, which are guided and urged against said edge, on which they rest especially by means of a roller or the like; and there is disposed on said slide means a stitcher which is capable of stitching the facing band and the front surface of the casing along an inclined direction of the needle.

The apparatus may also comprise means for supplying an edging tape and means for stretching the parts to be stitched, with adjustable supports.

Above the containing structure there is provided a pressure device constructed with dimensions slightly less than the mattress, in order to stabilize it together with the front surface of the casing to be stitched, and in order to compress it.

The supporting carriage may exhibit two articulated arms for two supporting rollers articulated to the carriage, and on one of the arms there is articulated a connecting rod which is further articulated to the trolley of the cutter, in order to drive it in front of the stitcher.

Advantageously, the trolley of the cutter supports said cutter by a column in an angularly and vertically adjustable manner.

The apparatus may further comprise guide means with a ribbed plate and with a screw for stretching the fabric of the facing band and guide means with a shaped sheet for stretching the fabric of the front surface of the casing.

BRIEF DESCRIPTION OF THE DRAWINGS

The invention will be better understood in accordance with the description and the accompanying drawing, which shows a practical, non-limiting exemplification of said invention. In the drawing:

FIGS. 9 and 10 are cross-sectional views along IX—IX and X—X in FIG. 8;

FIG. 11 is a view in horizontal cross-section from the line XI—XI in FIG. 10;

DESCRIPTION OF THE PREFERRED EMBODIMENT

Figure 1:
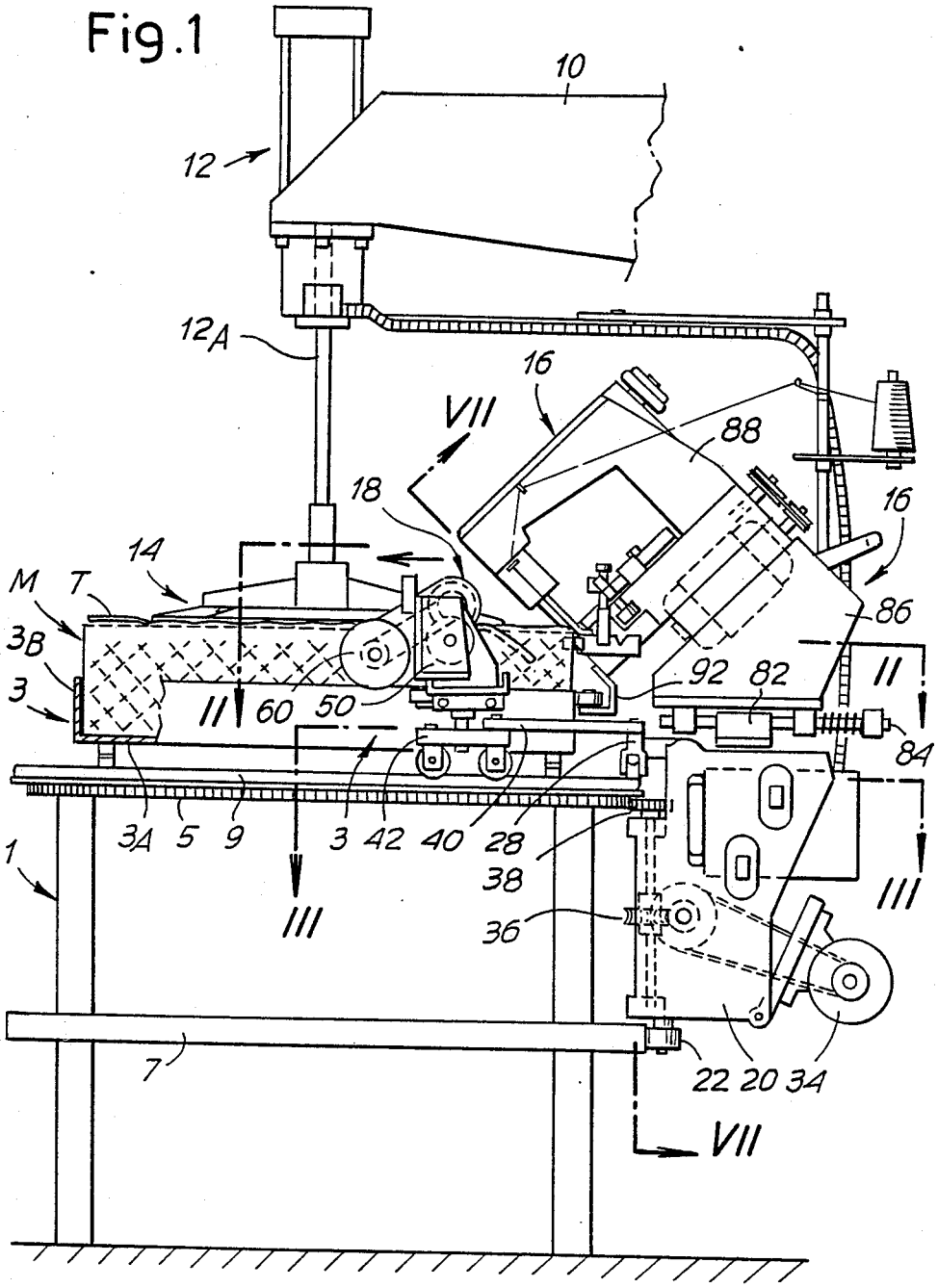
FIG. 1 is an overall side view.
Figures 2, 3:
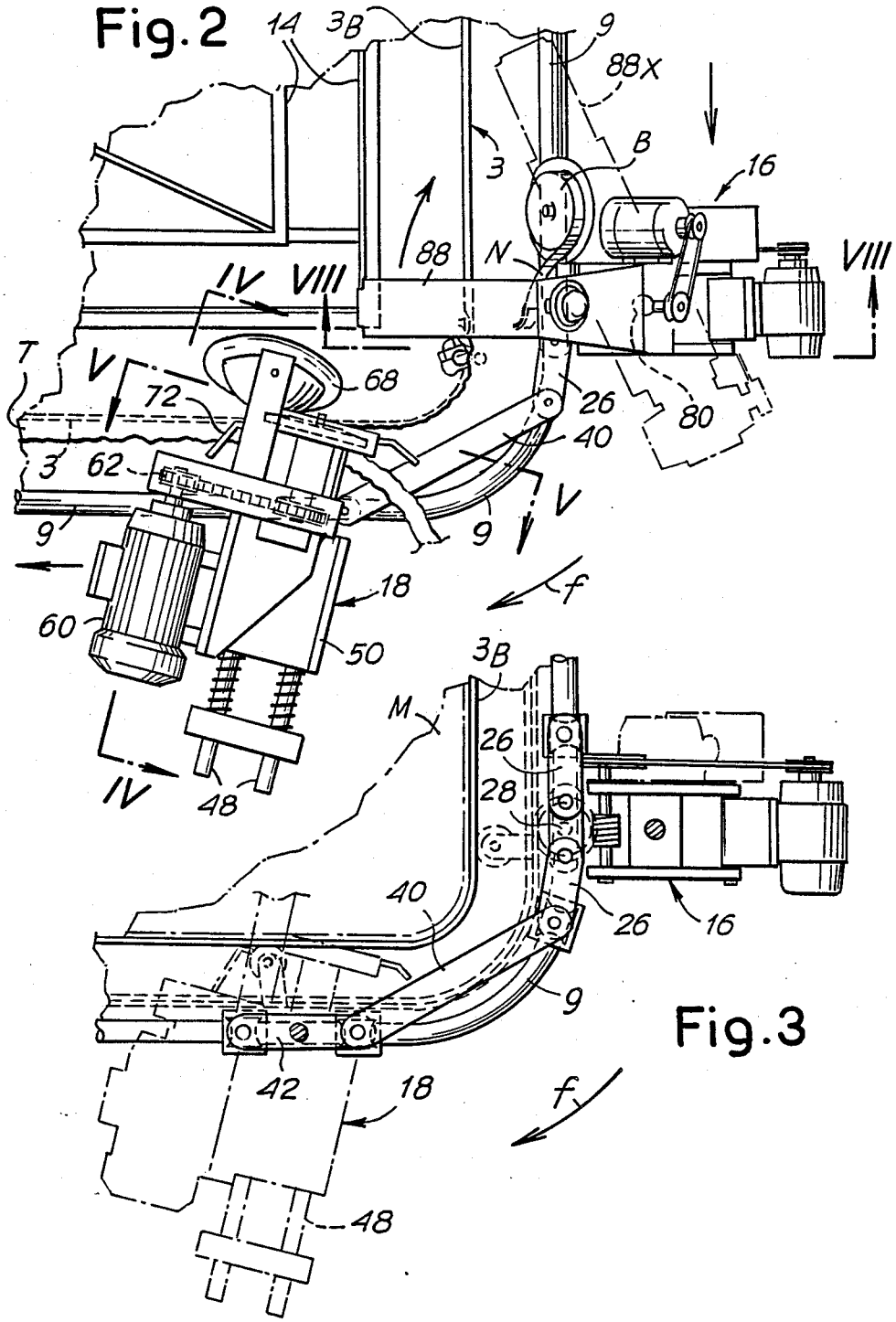
FIGS. 2 and 3 are views according to horizontal planes referenced II—II and III—III in FIG. 1.
Figure 4:
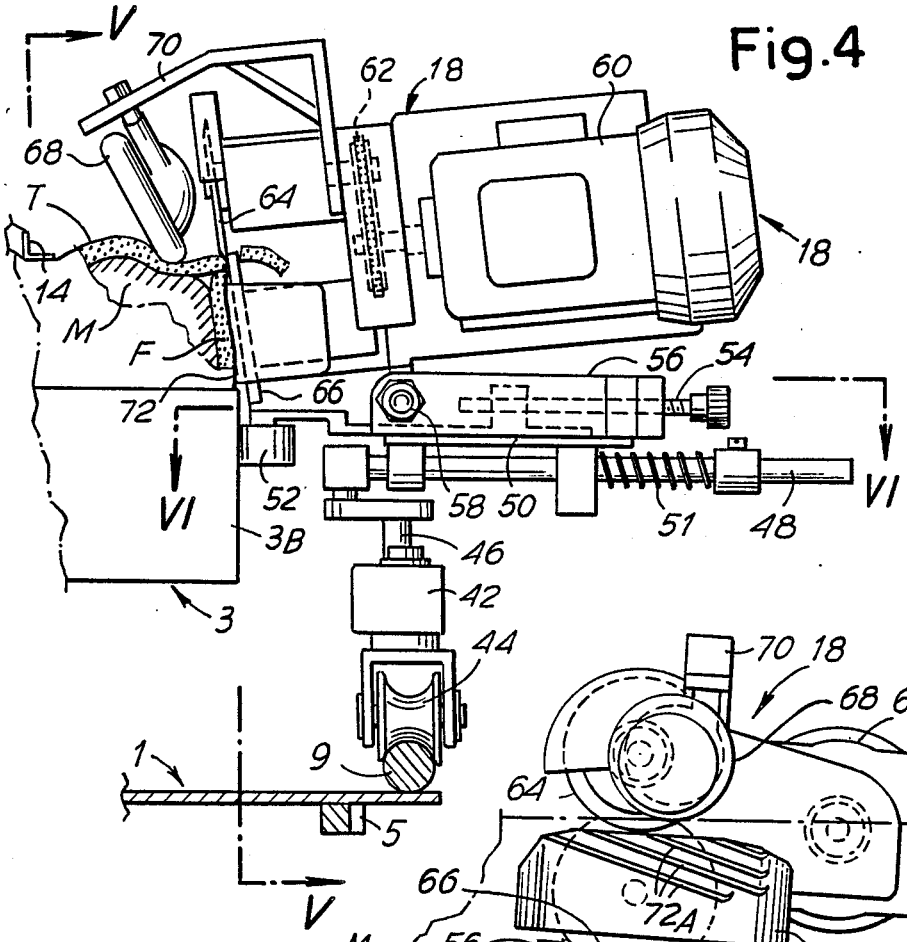
FIGS. 4, 5 and 6 are views of the stitcher along the lines IV—IV and V—V in FIG. 2 and VI—VI in FIG. 4.
Figure 5:
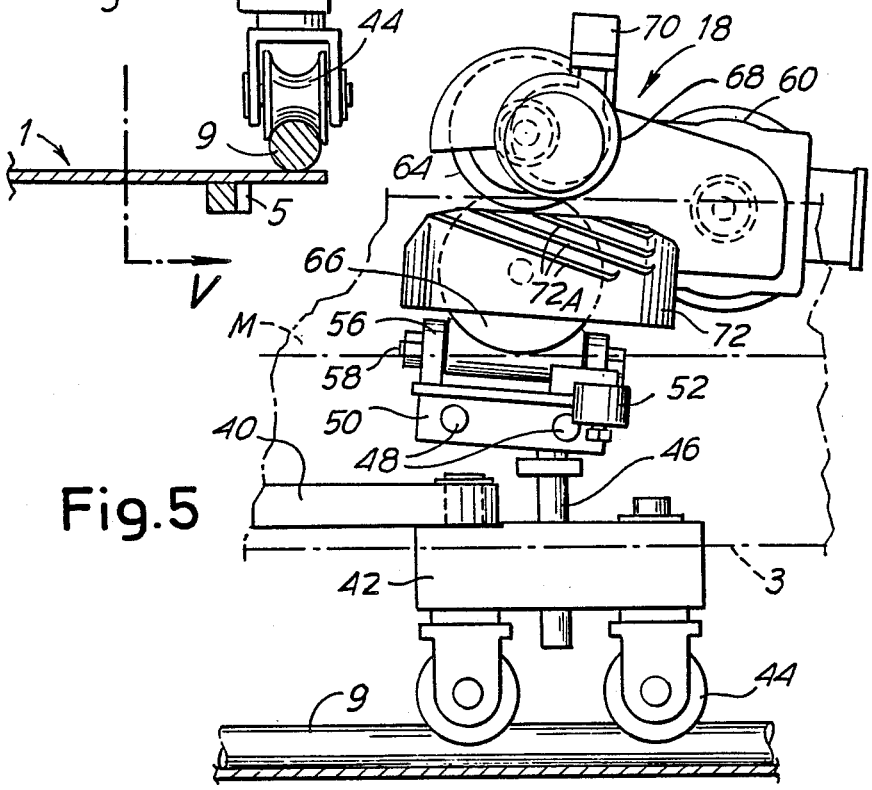
Figure 6:
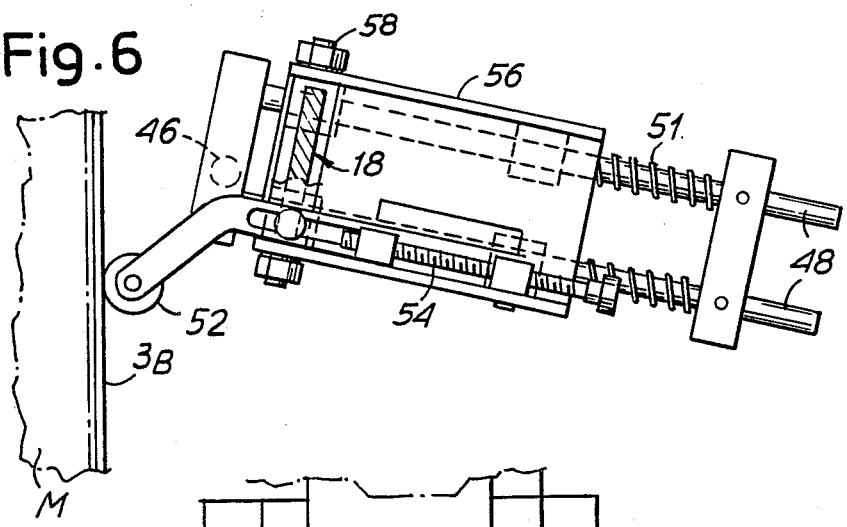

Referring to the accompanying drawing, and with initial reference, more particularly, to FIGS. 1 to 3, 1 indicates generally a bench, which supports on it a basin 3 capable of containing the mattress M which is being formed. Below the basin 3 some tracks are provided, and especially: a lower track 7 which constitutes a vertical rolling surface; a rack track 5 which serves for the advance of the cutting and stitching assemblies; and a cylindrical track 9 for supporting said assemblies. In the basin 3 the mattress M rests on the base 3A of the latter, which mattress is contained within the basin and, in particular, within the vertical boundary edge 3B of the same, from which it partially projects.

A fixed or lockable arm is provided above the bench 1 and the basin 3, which arm, in a central position with respect to the basin 3, carries a piston and cylinder system 12, to the stem 12A of which a pressure device 14 is fixed; the pressure device is capable of being maneuvered upwards and downwards and of being pressed onto the mattress M, of which it duplicates the shape in plan with a limited retraction with respect to the perimeter of said mattress.

The mattress being formed comprises—besides the internal structure M in metallic springs and appropriate layers of fibers or the like—also a boundary facing band F and an upper sheet T for forming the shell; the facing band F is placed between the structure of the mattress M and the edge 3B of the basin 3, while the sheet T is disposed above the structure M of the mattress and is pressed by the pressure device f4. The lower opposite front surface of the structure of the mattress M may already be equipped with its own sheet in a preceding working phase, or it may be applied in a phase subsequent to that in which the joining of the facing band F and of the sheet T by the equipment now being described is carried out. Both the facing band F and the sheet T may be fabric structures or alternatively, and advantageously, in the form of quilt. The facing band F is of such dimensions and in such a position as to be already completed with respect to the edge of the structure of the mattress M on which it is necessary to effect the connecting edging between the facing band F and the sheet T; however, the sheet T is of excess dimensions and must be cut by the cutter assembly, which is provided in the apparatus under discussion.

Two different working assemblies, and in particular a stitcher 16 and a cutter 18, run cyclically around the basin 3 along the rails 9 and 7 and with forward movement obtained with the aid of the rack 5. The stitcher 16 includes a lower supporting carriage 20, which rests by a roller 22 laterally against a rolling track 7, while said carriage 20 rests on the rail 9 (of cylindrical configuration) by means of orientable rollers 24 which are carried (see especially FIG. 7) by arms 26 which are symmetrically articulated to a trolley 28; the trolley 28 is provided with appendices 30 and 32 cooperating with the rail 9, like the grooved rollers 24. The carriage 20 carries a motor 34 which, by means of a reducer 36, actuates a toothed pinion 38 (FIGS. 1 and 8) which engages with the rack 5, in such a manner as to control the running of the assembly 16 of the stitcher and thus of the assembly 18 of the cutter (connected to the carriage 20 in the manner indicated below) cyclically around the basin 3, in order to carry out an operation of stitching and of edging at each revolution cycle.

The assembly of the cutter 18 will be described below.

To the carriage 20, and in particular to one of the arms 26 of the trolley 28, there is articulated a connecting rod 40, which is further articulated to a trolley 42 forming part of the assembly 18 of the cutter; said trolley 42 rests by rollers 44 on said rail 9, the rollers 44 themselves also being orientable with respect to the trolley to pass over the curves of the rail 9. By means of a stud 46, the trolley 42 supports the cutter (18) in an angularly and vertically adjustable manner. More specifically, the stud 46 supports a pair of guides 48 which are substantially horizontal and oriented towards the edge 3B of the basin 3 of the mattress being formed. A slide 50 can run along these guides 48, which slide is urged by means of springs 51 mounted on the guides 48 and urging the slide 50 towards the edge 3B of the basin 3 for the mattress; by means of an associated arm projecting towards the edge 3B, the slide 50 supports a roller tappet 52 which rests on the edge 3B. A support 56 for the cutter can be registered in position on the slide 50 by means of a threaded spindle 54. The complex unit 18 of the cutter is articulated to this support 56 at 58 (according to an axis which lies in an approximately vertical plane and approximately parallel to the edge 3B in the rectilinear zones of the same). This complex unit 18 comprises a motor 60 with a transmission 62 for the blade 64, which is oriented so as to be slightly inclined with respect to a vertical plane and is capable of cooperating with a counterblade disk carried by the structure 18. The assembly of the cutter 18 also comprises a rubberized wheel 68, carried by a supporting arm 70 in a manner expediently orientable to act on the upper sheet T held between the structure of the mattress M and the pressure device 14; in this way, the sheet T is urged to be stressed towards the outside and towards the zone of cooperation between the rotating blade 64 and the counterdisk 66 and thus to effect the cutting of the external excess part, in such a manner as to align the cut edge of the sheet T with the upper edge of the facing band F. The assembly 18 of the cutter also comprises an apron 72 with inclined ribs 72A; the apron 72 comes to rest on the facing band F, retaining it between itself and the structure M of the mattress, in order to stabilize the position thereof and to extend said facing band F in an upward direction and thus to approach the edge of the sheet T, the boundary edge of which is delimited by the cut made by the components 64, 66 of the cutter in order to remove the excess thereof.

The cutter 18 which has now been described is driven in the direction of the arrow f from the assembly 16 of the stitcher and thus from the carriage 20, towards the connecting rod 40, in such a manner that the cutter operates ahead of the stitching of the edges of the facing band F and of the sheet T, which are expediently completed by an edging ribbon which is described below. The possibility of pivoting between the carriage 20 and the assembly 16 of the cutter—operated by means of one of the arms 26 and the connecting rod 40—permits the ensuring of the thrust of the cutter in advance on the carriage 20 also along the curve of the rails 9, 7 and 5 surrounding the basin 3.

On the carriage 20 there is provided an articulation 80 for a support 82, which is thus orientable and which, in its turn, carries pairs of substantially horizontal guides 84 for the body 86 forming part of the assembly of the stitcher 16; the body 86 is urged towards the edge 3B by springs fitted around the guides 84 and reacting on the running lugs of the body 86 on said guides 84. The body 86 forms sliding guides to permit the sliding in the direction of the arrow f88 of a second body 88, forming part of the assembly 16 of the stitcher. The complex unit formed by the bodies 86 and 88 is capable of rotating about the vertical articulation axis 80, in such a manner that the latter can assume from the working position indicated in solid lines in FIG. 2 an exclusion position angularly displaced about the axis of the articulation 80 and which is indicated on an indicative basis and with the reference 88X in said FIG. 2.

The actual stitching machine, which is carried by the body 88, is of the type which is generically known per se, but is mounted pivotally for the displacement at 90° for the start of work. Said machine, together with the body 88, is positioned in relation to the edge 3B with the aid of a scanning roller 90 carried by arms 92 forming part of the body 88, the displacement of the body 88 taking place in the direction of the arrow f88 with respect to the body 86 respectively, it being nevertheless possible for the mutual position between the bodies 86 and 88 to be registered in the direction of the arrow f88 and the support being ensured by means of the sliding of the complex unit on the guides 84 combined with the support 82.

Figure 7:
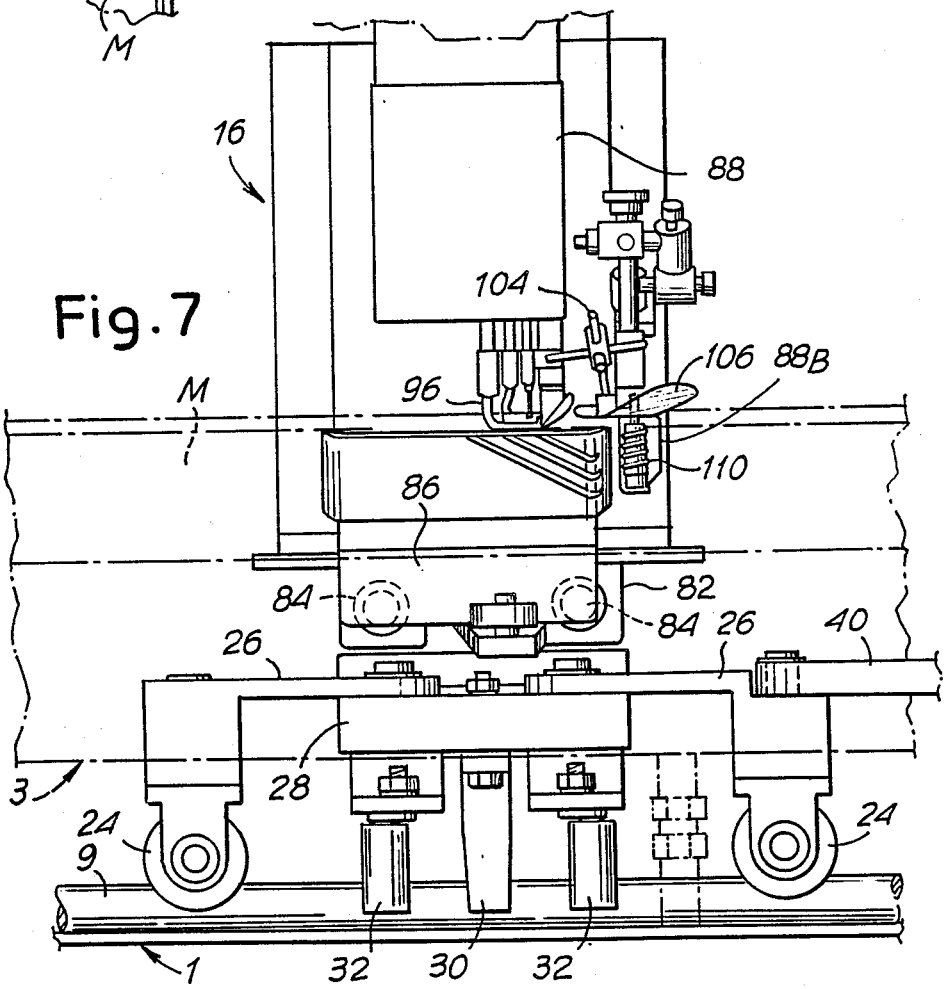
FIG. 7 is a view of the stitcher from the divided lines VII—VII in FIGS. 1 and 8.
Figure 8:
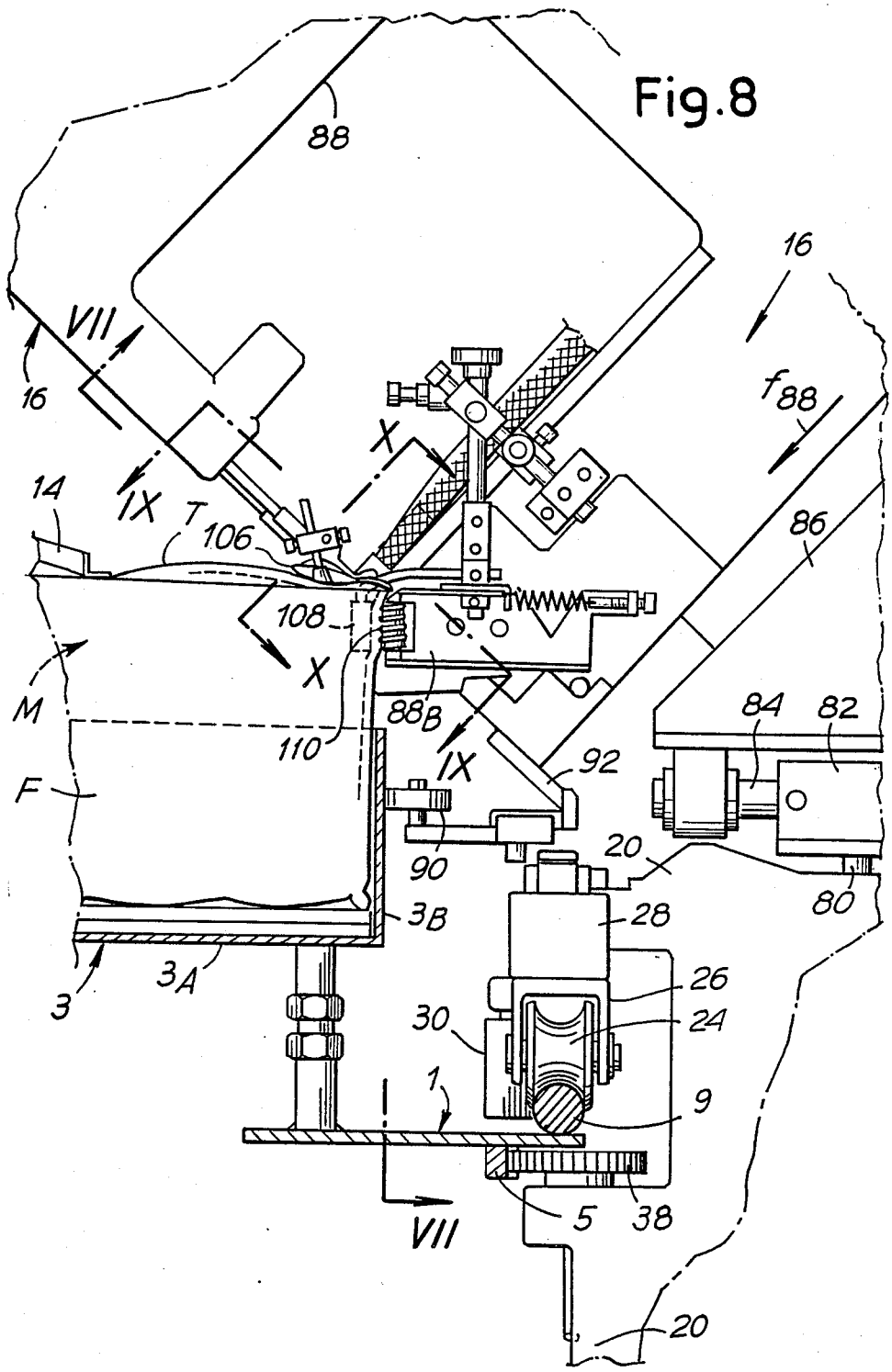
FIG. 8 is a view from the line VIII—VIII in FIG. 2.
Figures 12, 13, 14:
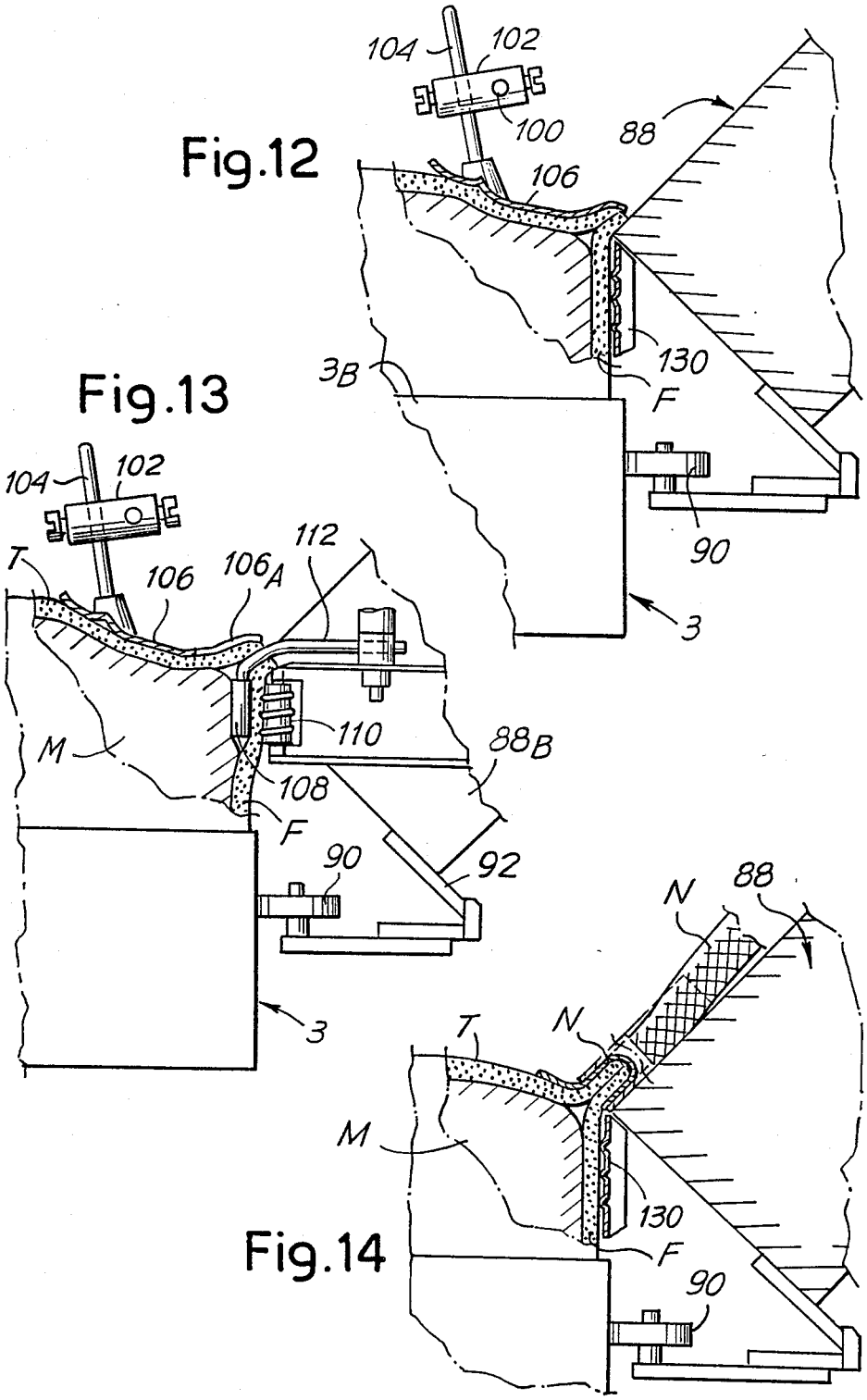
FIGS. 12, 13 and 14 are transverse cross-sections along XII—XII, XIII—XIII and XIV—XIV in FIG. 9.
Figure 15:
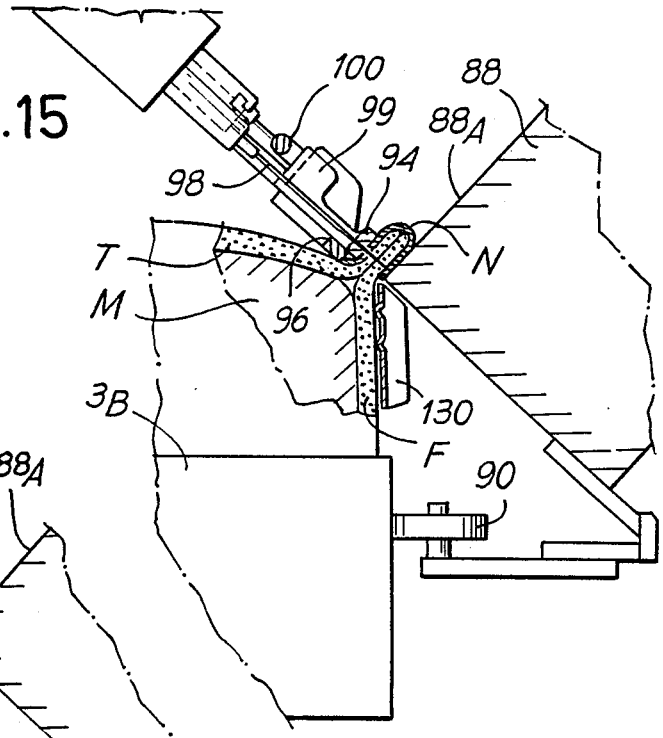
FIGS. 15 and 16 are cross-sectional views, in two positions of the components represented therein, taken along the line XVI—XVI in FIG. 9.
Figure 16:
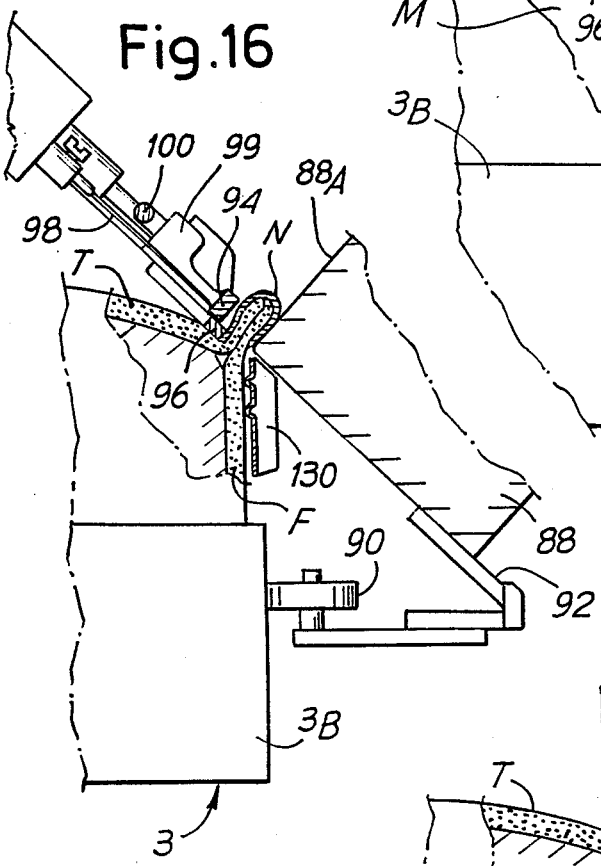
Figure 17:
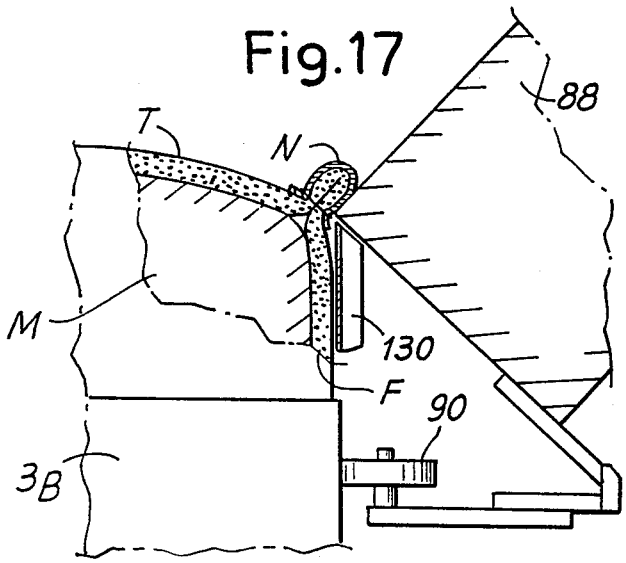
FIG. 17 shows a detail cross-section along XVII—XVII, also in FIG. 9.

Some of the components of the stitcher carried by the body 88 are illustrated—in FIG. 7 et seq.—and in particular a knurled shoe 94 and a further shoe 96 which are alternately active to press the edges of the sheet T and of the facing band F for stitching. 98 indicates the stitching needle; both the needle 98 and the two shoes 94 and 96 are given movements which are alternating and expediently phase-shifted, to obtain the stitching in a manner which is known per se; FIGS. 15 and 16 show two mutual positions of the two shoes 94 and 96. A support 99—carried by the body 88 by means of a registration stud—supports an arm 100. To the arm 100 there is fitted, in such a manner as to be adjustable by means of a clamp 102 and a shaft 104, a shaped shoe 106 (FIGS. 9, 12 and 13 in particular), which is intended to press on the sheet T in order to urge it towards the outside and to extend it into the position of coupling with the corresponding edge of the facing band F, in such a manner as to present it in the correct position for stitching. The shaped shoe 106 exhibits a broad curvature 106A, corresponding to which there are two cooperating cylinders 108 and 110 carried by the complex unit 88 of the stitcher; in particular, the cylinder 108 is carried by an arm 112 and is disposed between the structure of the mattress M and the facing band F, the arm 112 being interposed between the two edges to be stitched and being in correspondence with the hollow 106A; the cylinder 110 is threaded and thus exhibits a helical projection and is carried by a part 88B of the body 88 of the stitcher.

Finally, the cylinders 108 and 110 serve to stretch and to regularize the position of the facing band F, while the laminar shaped shoe 106, 106A serves to stabilize the position of the sheet T, in such a manner that the two edges of the facing band F and of the sheet T (the latter cut by the blade of the cutter) are presented in the correct position for stitching.

Between the components 106, 108 and 110 on the one hand and the shoes 94, 96 and the needle 98 on the other hand, there is a complex unit 120 for supplying the edging tape N. This tape N is supplied from a spool store B carried by the assembly 16 (see FIG. 2) and is inserted into a guide formed by two components 122 and 124 (see FIGS. 10 and 11) which bend it transversely in a direction towards the edges of the facing band F and of the sheet T to be stitched, in order then to deflect it through approximately 90°, as shown in particular in FIG. 10 by a guide section 126. The components 122, 124, 126 are carried by a bracket 128, which is fixed to the body 88 by means of appropriate adjustment devices. The guide components 122, 124, 126 bend the tape N in such a manner as to wrap it in a U above the aligned edges of the facing band F and of the sheet T.

Finally, the stitching assembly 16 follows the previous assembly of the cutter 18 and exhibits in sequence: the complex unit of the components 106, 108, 110 which arrange the facing band F and the sheet T one against the other in order to bring together the edges thereof and to regularize the position of said elements; the complex unit of the components 122, 124, 126 which present the tape N and arrange it, curved in a U, above and along the edges of the sheet T and of the facing band F to be stitched; the pairs of shoes 94, 96 together with the needle 98, which effect the stitching, reacting on a support surface 88A carried by the body 88 and which can exhibit appropriate shapes and reliefs for the guide. There may also be provided an appropriate apron 130 also for guiding the facing band F, in the part of the latter which projects beyond the edge 3B of the basin 3. The various components which have been described above and which follow one another in the forward movement of the cutter and of the stitching assembly along the edges to be stitched of the sheet T and of the facing strip F ensure the positioning thereof without the intervention of the operator and thus in an automatic manner, in order to effect the stitching of the edges with the finishing and covering tape N. The speed of operation is greater in correspondence with the rectilinear sides of the basin 3, 3A, 3B, while it is expediently slowed down in correspondence with the curves of the rail 9 for the connection between the rectilinear sections. In addition to what has already been mentioned, it is possible to provide further means for regulating the relative position between the fabric T and the facing band F for a correct relative position between these and for a correct positioning of the tape N on these, in such a manner as to obtain nevertheless a very regular stitching, which ensures, within very limited tolerances, the dimension which is achieved in the mattress obtained, by the stitching procedures indicated above.

These and other objects and advantages will be evident to experts skilled in the art.

It is understood that the drawing shows only an exemplification given only by way of practical demonstration of the invention, it being possible for this invention to vary in its forms and arrangements without nevertheless departing from the scope of the concept which is taught by said invention. The possible presence of reference numerals in the attached claims has the purpose of facilitating the reading of the claims with reference to the description and to the drawing, and does not limit the scope of the protection represented by the claims.

I claim:

1. An apparatus for forming a cover casing on a mattress body, comprising:

containment means for positioning the mattress body with a tape-like facing band arranged annularly about the mattress body and with a casing front surface supported on the mattress body, said containment means including a boundary edge, from which boundary edge, the mattress body and the tape-like facing edge extend;

guide rail means including a guide extending around said edge and a rack extending around said edge;

a supporting carriage;

roller means for supporting said carriage through engagement with said guide rail means, said roller means including roller elements orientable for passing over curves of said guide rail, formed at corners of said containment means and including toothed wheel elements engaging said rack;

a trolley movable on said rail means, said trolley being connected to said supporting carriage by an articulation;

stitcher means positioned on one of said supporting carriage and said trolley; and, cutter means positioned on one of said supporting carriage and said trolley, said cutter means acting in a position in front of said stitcher means.

2. An apparatus according to claim 1, further comprising fabric drawing and positioning means for positioning said tape-like facing band and for positioning said front surface in a stitching position.

3. An apparatus according to claim 1, further comprising: slide means positioned on said supporting carriage, said slide means being urged to rest against said boundary edge and including a roller guided by said boundary edge, said stitcher means being positioned on said slide means for stitching said facing band and stitching said front surface with a needle disposed at an inclination with respect to said facing band and the front surface of the casing.

4. An apparatus according to claim 1, further comprising: means for supplying edging tape and means for stretching parts to be stitched, said means for stretching parts to be stitched including an adjustable support.

5. An apparatus according to claim 1, further comprising pressure means having dimensions slightly less than said mattress body for compressing said mattress body and positioning said mattress body with respect to said front cover.

6. An apparatus according to claim 1, wherein said supporting carriage includes two articulated arms connected to supporting rollers of said roller means, a connection rod being articulated to one of said articulated arms, said one of said articulated arms being connected to said trolley in order to drive said trolley in front of said supporting carriage, said cutter means being positioned on said trolley and said stitcher means being supported on said supporting carriage.

7. An apparatus according to claim 1, wherein said trolley includes a column member for angularly supporting said cutter means in a vertically adjustable manner.

8. An apparatus according to claim 1, further comprising facing band guide stretching means including a rib plate element engaging said facing band for stretching fabric of the facing band and front surface stretching guide means for engaging the front surface and stretching the front surface relative to the mattress bed.

* * * * *